US009874325B2

(12) United States Patent
Deely et al.

(10) Patent No.: US 9,874,325 B2
(45) Date of Patent: Jan. 23, 2018

(54) CONFIGURABLE OVERHEAD LIGHT

(71) Applicant: SIMPLY LEDS, LLC, Garden City, ID (US)

(72) Inventors: Robert Deely, Garden City, ID (US); Daniel Donegan, Garden City, ID (US)

(73) Assignee: SIMPLY LEDS, LLC, Garden City, ID (US)

( * ) Notice: Subject to any disclaimer, the term of this patent is extended or adjusted under 35 U.S.C. 154(b) by 8 days.

(21) Appl. No.: 15/096,060

(22) Filed: Apr. 11, 2016

(65) Prior Publication Data

US 2016/0298820 A1 Oct. 13, 2016

Related U.S. Application Data

(60) Provisional application No. 62/146,121, filed on Apr. 10, 2015.

(51) Int. Cl.

| | |
|---|---|
| ***F21V 7/00*** | (2006.01) |
| ***F21S 8/08*** | (2006.01) |
| ***F21V 5/04*** | (2006.01) |
| ***F21V 5/08*** | (2006.01) |
| *F21V 31/00* | (2006.01) |
| *F21W 131/103* | (2006.01) |
| *F21Y 115/10* | (2016.01) |

(52) U.S. Cl.
CPC ..... *F21S 8/088* (2013.01); *F21V 5/045* (2013.01); *F21V 5/08* (2013.01); *F21V 31/005* (2013.01); *F21W 2131/103* (2013.01); *F21Y 2115/10* (2016.08)

(58) Field of Classification Search
CPC ..... F21S 8/088; F21V 31/005; F21V 5/045; F21V 5/08; F21W 2131/103; F21Y 2115/10
USPC ..... 362/348
See application file for complete search history.

(56) References Cited

U.S. PATENT DOCUMENTS

| | | | | |
|---|---|---|---|---|
| 8,047,674 | B2 * | 11/2011 | Liu | F21V 29/004 362/218 |
| 9,535,264 | B2 * | 1/2017 | Gupta | G02C 7/085 |
| 2011/0235186 | A1 * | 9/2011 | Blum | G02B 3/14 359/665 |

* cited by examiner

*Primary Examiner* — Seung Lee
(74) *Attorney, Agent, or Firm* — Robert L. Shaver; Shaver & Swanson, LLP

(57) ABSTRACT

A configurable LED overhead light with a selection of lenses. The lenses are selected for the pattern of light, distance and shape of the desired illumination, of a particular installation. By varying the lens shapes and surface textures, asymmetric patterns can be achieved, and non-LED fixtures can be replaced with LED fixtures that optimize the light distribution to a particular installation site.

12 Claims, 5 Drawing Sheets

CONFIGURABLE OVERHEAD LIGHT

PRIORITY/CROSS-REFERENCE TO RELATED APPLICATIONS

This application claims the benefit of U.S. Provisional Application No. 62/146,121 filed Apr. 10, 2015, the disclosure of which is incorporated by reference.

TECHNICAL FIELD

The presently disclosed technology relates to a light fixture, and more particularly to an overhead LED light fixture in which the light pattern can be adjusted according to the needs at a particular site.

BACKGROUND

A problem with current lighting strategies is that the typical lighting fixture sends light out in a generally symmetrical pattern. This can result in areas being illuminated which should not be illuminated, such as vehicular roadways where the light can distract drivers. Light is often wasted as it is mistakenly directed upward into the night sky. This costs money, and needlessly contributes to light pollution in a city. A lighted area can also have a border along its edge that does not need to be lighted, and is detrimental to drivers or pedestrians if it is lighted. If the spread of light could be accurately controlled, savings in energy would be achieved, and only those areas selected to be lighted would receive light. If the configurable light is also an LED fixture, further savings could be achieved.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

Disclosed is a configurable overhead light fixture, meaning that the output of the light can be adjusted to fit the requirements of a particular site, before or after the light is installed. The overhead light is made up of a heat sink and initial LEDs which are typically installed first. The heat sink is planar, and has a first and a second surface. It has LED lights attached to the first surface, which would typically be the surface which faces down, so that an area where people may be present is illuminated from above. The heat sink has a second surface, to which are attached a plurality of heat radiating fins. The heat sink and fins could be an extruded piece, comb line in cross section, and as long as the user desires.

The lighting pattern selected can be asymmetrical, oblong, circular, squarish, or other shapes, with the lighting pattern determined by the LED covers that are selected. The LEDs are connected to the heat sink and to a power source outside the heat sink. The LEDs in the heat sink would be chosen for a lumen output from 1000 to 10,000 lumens, and color temperature range typically from 2700K to 5600K. The selection of specific LEDs would depend on the location and desired light pattern of a particular installation.

The overhead light could be over a parking lot, over a sidewalk, over an entry to a building, in a hallway or warehouse, etc. It would typically be installed in an area where it is desirable to have a weather resistant light, and weather resistance is a feature of the light. The lenses can also be selected to minimize light going up into the night sky, to reduce light pollution in a city and also get the most usable light out of any amount of power.

After the heat sink is installed with LEDs of the desired characteristic, lenses are attached directly to the heat sink. The surface of the heat sink has grooves, typically circular, which correspond to the rim (circumferential edge) of the generally curvilinear dome shaped lenses. The term curvilinear dome shaped includes hemispherical shapes, bulbous shapes, columnar shapes with curved tops, flat domes, tall domes, sections of a sphere, and similar bulbous, protruding and rounded shapes.

The lens grooves are incised into the heat sink surface, and would typically be 1.75" in diameter, and 0.050" deep in the heat sink material. The heat sink may have multiple LEDs on its surface, each with a groove for the lens. Each lens groove may also surround multiple LEDs. Lenses are selected for the spread of light which is desired, and for this a wide selection of lenses are possible. Some lenses which can be selected include:

- Clear lens, for maximum lumen output
- Frosted lens, for light dispersion, hiding the LED and for cutting glare
- Lens with ribs on the outside of the dome, for accurate distribution of light at various angles to the LED
- Lens with ribs on the inside of the dome, for redirecting light away from certain directions
- Lens with internal opaque reflective surface(s) for blocking light in one direction and reflecting light in another direction
- Directional lens, with a protruding wedge shaped portion for directing light in a particular pattern.

The lenses may be attached to the heat sink by placing an adhesive in the lens grooves, and then placing the base of the lenses in the lens groove. The adhesive may be silicone, epoxy, or other waterproof materials. This method also provides a weather tight seal for the LED light.

Another option for attaching the lenses to the heat sink is cutting screw threads in the outside edge of each groove and using matching screw threads on the base of each lens with a rubber or other flexible weather tight gasket in the base of each groove. This method also provides a weather tight seal for the LED light.

Another attachment method can be to install an o-ring in the sidewalls of the lens groove, which would form a seal as the lens is pressed or screwed in place. This method also provides a weather tight seal for the LED light.

The disclosed technology also includes a method of retrofitting a configurable LED light into an existing overhead light. The method is made up of the following steps:

- removing a non-LED light body from an overhead light fixture;
- placing a power source for the LED lamp body in the now empty overhead light fixture;
- placing an LED lamp body in the now empty overhead light fixture, with the replacement lamp body made up of a planar heat sink with a first surface and a second surface. More than one heat radiating fins attached to said second surface of the heat sink;
- At least one and preferably two LED lights mounted on the first surface of the heat sink, the LED lights surrounded by a lens groove defined in the first surface of the heat sink. Typically the lens groove surrounds each LED light, or each grouping of LED lights. The first surface of the heat sink would typically be installed to face down, onto an area to be illuminated. The LED lights are connected to a power source;

determining a preferred light pattern to be illuminated by the light fixture;

selecting a curvilinear dome shaped lens with a shape and surface pattern matching the selected light pattern to be illuminated;

attaching the selected lenses to the lens groove to cover and seal off the LEDs.

The method also includes the step of shaping the light pattern as the light is mounted in a fixture, by use of one or more of these options: The spread of the light field can be adjusted during or after installation of the light body. This can be done is several ways.

1. placing the proper various lens on the heat sink
2. rotating the lens on the heat sink before "locking" the lens, or permanently sealing it.
3. rotating the light body in the fixture.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE PREFERRED EMBODIMENTS

Figure 1:
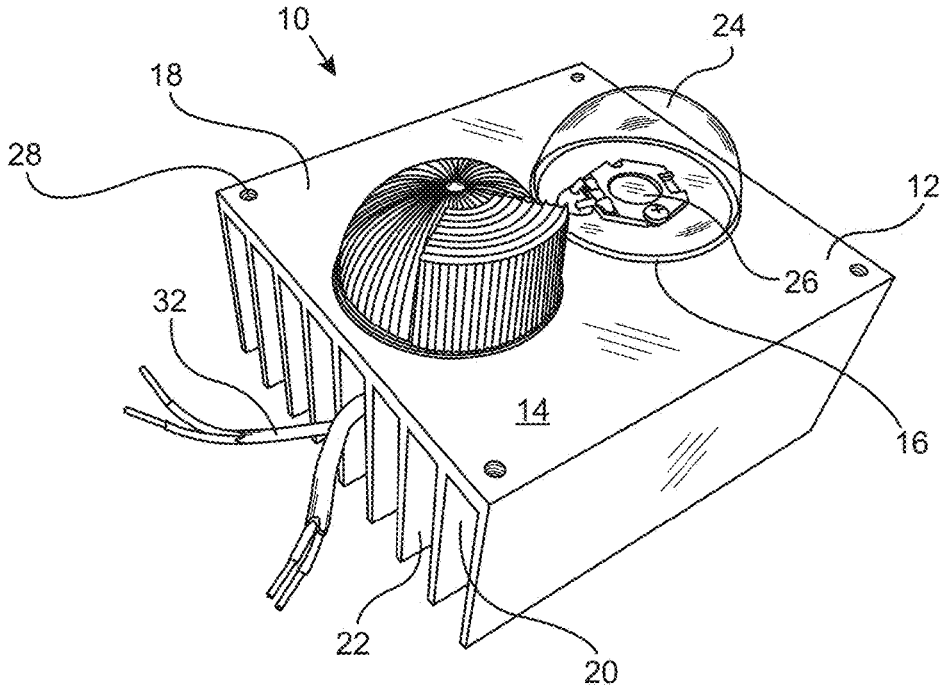
FIG. 1 is a perspective view of the light fixture with lenses attached.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 shows the configurable overhead light 10 which is made up of the lamp body 12, which is a heat sink 14, with lens positions 16 on a first surface 18. Second surface 20 of said heat sink 14 has attached to it a number of heat radiating fins 22. Shown in FIG. 1 are two lenses 24, which cover an LED 26. Shown are screw or bolt holes 28 which are used to secure the lamp body to the underside of a surface, which as the underside of a covered walkway, or the inside of an overhead light, such as found in a parking lot.

Figure 2:
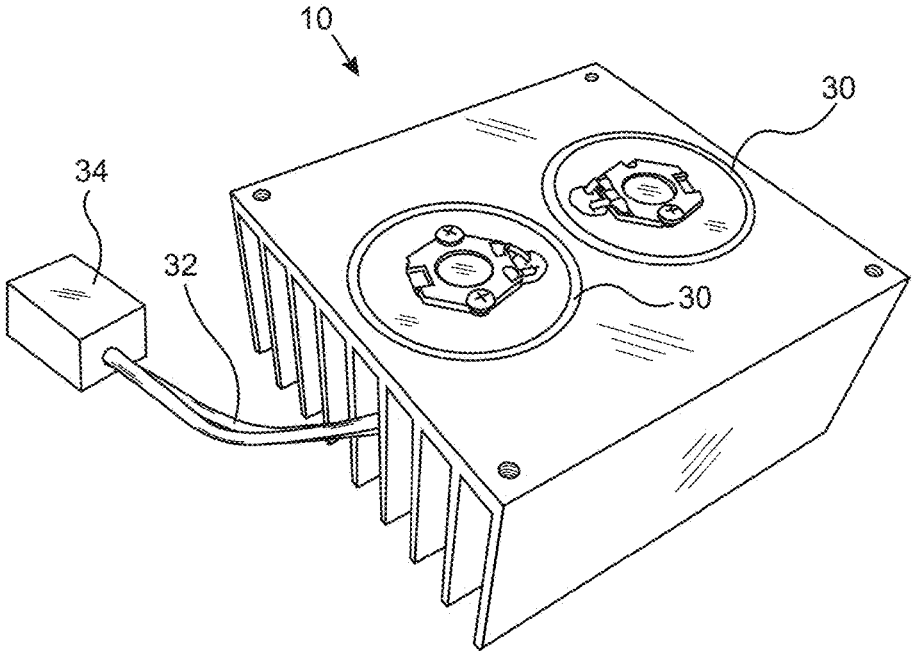
FIG. 2 is a perspective view of the light fixture with no lenses attached
Figure 3:
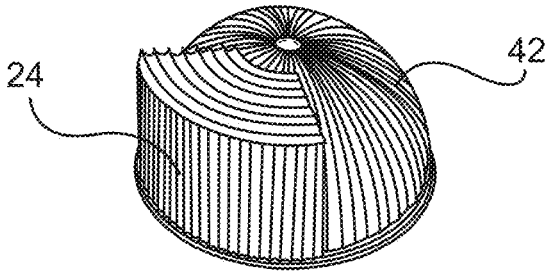
FIG. 3 is a perspective view of a lens with an asymmetrical region.
Figure 4:
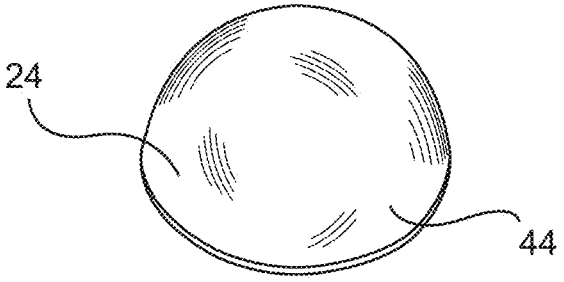
FIG. 4 is a perspective view of a lens with a frosted finish.
Figure 5:
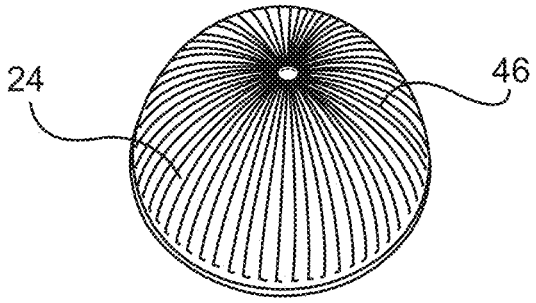
FIG. 5 is a perspective view of a lens with a ribbed surface pattern.
Figure 6:
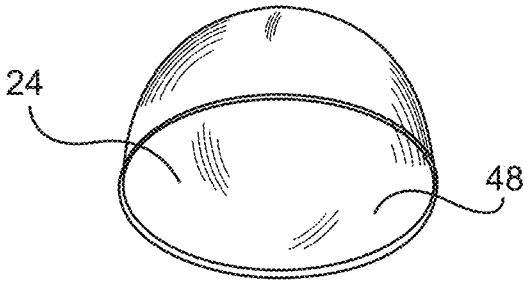
FIG. 6 is a perspective view of a lens with a clear material.

FIG. 2 shows the same overhead light 10 with the lens 24 removed, which more clearly shows the LEDs 26, and a lens groove 30. Also shown is wiring 32 which is attached at one end to the LEDs 26 and at the other end to a power source 34. The power source would be wall current in a covered walkway, or power terminals in a light fixture housing.

The size of the heat sink can vary based on the particular application, but a typical size is 4" by 4", and 3/16" thick, made of aluminum. The size of the heat sink would be based on approximately 6 square inches per watt of heat sink surface area. The heat radiating fins would typically be aluminum, approximately 2"×4", and 2" long. The entire unit of the heat sink and fins could be extruded as one piece. The lenses can also be different diameters and shapes, with a typical diameter of the lens being about 1¾". The lenses are preferably made of plastic, with polycarbonate being a preferred material. A suitable LED is made by Bridgelux, such as the BXRC-50C1000 model.

FIGS. 3, 4, 5, 6, and 7, 15 and 16 show different shaped lenses 24 which are possible to use with the disclosed configurable overhead light 10. These include the columnar wedge shape lens 42 attached to a curvilinear dome of FIG. 3, a frosted hemisphere 44 of FIG. 4, a ribbed hemisphere 46 of FIG. 5, and the clear hemisphere 48 of FIG. 6. Each of these provide a light spread of a different shape, and would be selected depending on the desired pattern of light.

Figure 7:
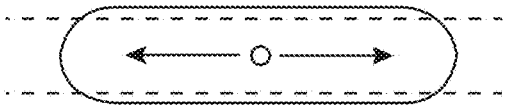
FIG. 7 is a top view of a two way lateral light distribution

FIGS. 7-12 show different light dispersion patterns which might be selected for a particular application, with appropriate lenses 24 and LEDs 26 selected to illuminate the selected pattern. Typical spreads of these patterns might be 100 feet long in any direction, to smaller patterns of 20 feet in a direction. FIG. 7 is a pattern for a walkway, path or sidewalk. In this application, an overhead light 10 is placed approximately in the center of the pathway. This is referred to as a two-way lateral distribution and has a preferred lateral width of 15 degrees in the cone of maximum candlepower.

The two principle light concentrations are in opposite directions in the roadway. This type is generally applicable to illuminate locations near the center of the roadway where the mounting height is approximately equal to the roadway width.

Figure 8:
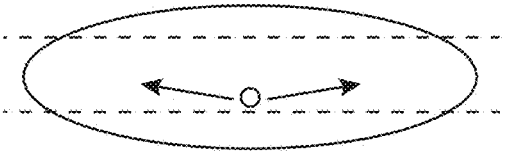
FIG. 8 is a top view of a two way lateral light distribution for wide walkways.

FIG. 8 shows a light distribution pattern referred to as TYPE II. This distribution is used for wide walkways, on-ramps and entrance roadways, as well as other long, narrow lighting situations such as warehouse aisle ways. This type of lighting is meant for lighting larger areas and usually is located near the roadside or warehouse pallet racks. This type of lighting is found mostly on smaller side streets, jogging paths, or warehouses.

TYPE II light distributions have a preferred lateral width of 25 degrees. They are generally applicable to luminaries located at or near the side of a relatively narrow roadway where the width of the roadway does not exceed 1.75 times the designed mounting height.

Figure 9:
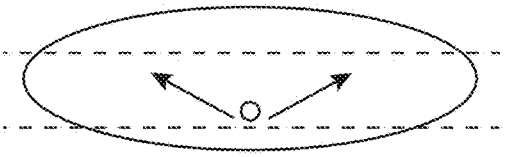
FIG. 9 is a top view of a two way lateral light distribution for roadway or parking area lighting.

FIG. 9 shows a light distribution referred to as TYPE III. TYPE III distribution is meant for roadway lighting, general parking areas, and other areas where a larger area of lighting is required. TYPE III lighting needs to be placed to the side of the area, allowing the light to project outward and fill the area. This produces a filling light flow.

TYPE III light distributions have the preferred lateral width of 40 degrees. This distribution is intended for luminaries mounted at or near the side of medium width roadways or areas, where the width of the roadways or area, does not exceed 2.75 times the mounting height.

Figure 10:
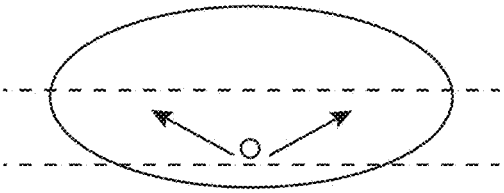
FIG. 10 is a top view of a semi-circular lighting spread, for along the sides of buildings.

FIG. 10 is a type of light distribution referred to as TYPE IV. The TYPE IV distribution produces a semicircular light meant for mounting on the sides of buildings and walls. It's best for illuminating the perimeter of parking areas and businesses. The intensity of the Type IV lighting has the same intensity at angles from 90 degrees to 270 degrees. Type IV light distributions have a preferred lateral width of 60 degrees. This distribution is intended for side-of-road mounting and is generally used on wide roadways where the roadway width does not exceed 3.7 times the mounting height.

Figure 11:
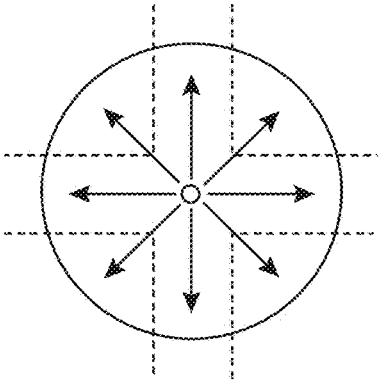
FIG. 11 is a top view of a circular light distribution with the light intensity equal and symmetrical in all directions.

FIG. 11 shows a type of illumination pattern referred to as TYPE V. Type V produces a circular distribution that has the same intensity at all angles. This distribution has a circular symmetry of candlepower that is essentially the same at all lateral angles. It is intended for a luminaire mounting at or near center of roadways, on the center island of a parkway, and intersections. It is also meant for large, commercial parking lot lighting as well as areas where sufficient, evenly distributed light is necessary.

Figure 12:
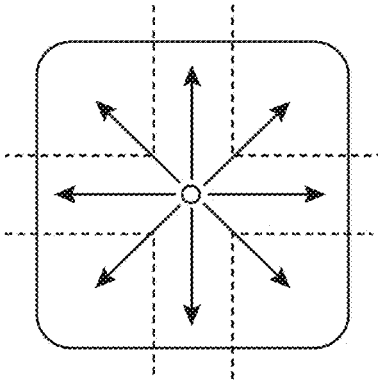
FIG. 12 is a top view of a generally square light spread, in which light symmetry is equal in all directions, such as in parking lots.

FIG. 12 shows a type of lighting referred to as TYPE VS (square). Type VS produces a square distribution that has the same intensity at all angles. This distribution has a square symmetry of a candlepower that is essentially the same at all lateral angles. It is intended for luminaire mounting at or near center of roadways, center islands of parkway, and intersections. It is also meant for large, commercial parking lot lighting as well as areas where sufficient, evenly distributed light is necessary. TYPE VS is used where the light pattern needs a more defined edge.

Figure 13:
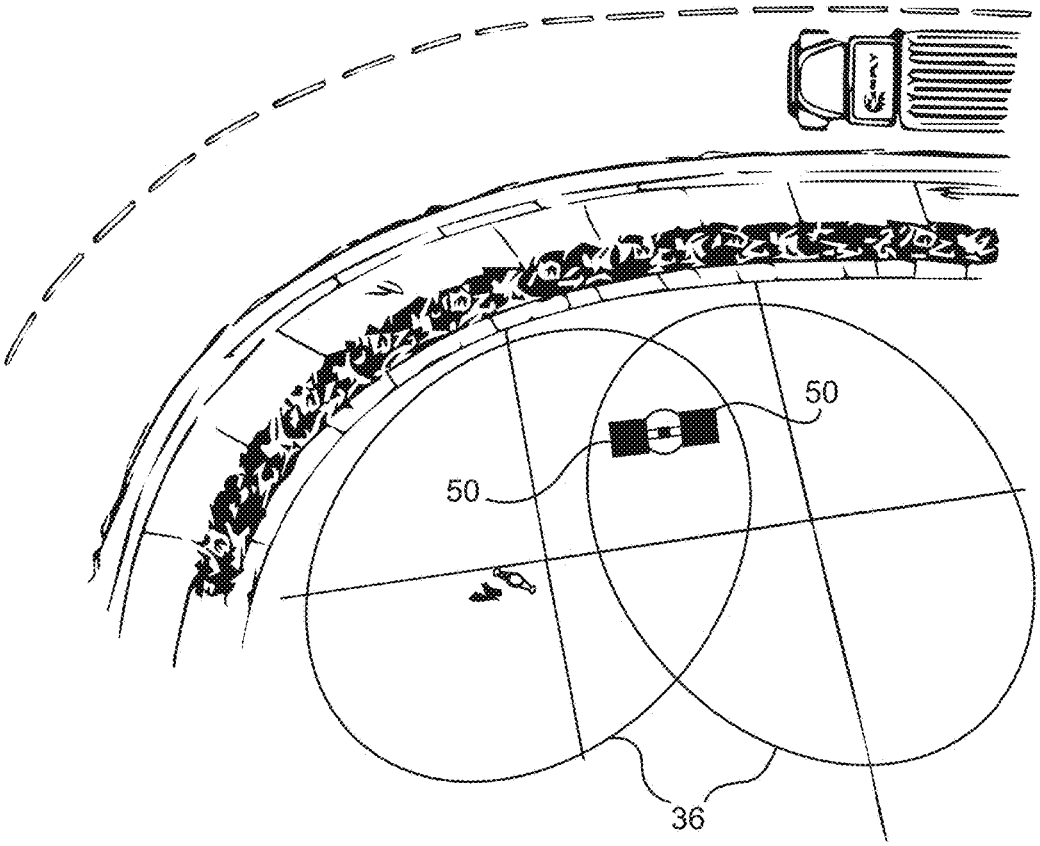
FIG. 13 is an overhead view of asymmetrical light spread from light sources.

FIG. 13 shows one potential installation in which a pair of overhead lights 50 are mounted in one location with each of the overhead lights 50 providing an asymmetrical area of illumination 36. In this particular case the overhead lights are in a parking lot and it is desired to not illuminate the nearby roadway or sidewalk. To achieve this lenses are selected which illuminate the asymmetrical light distribution patterns 36 shown in the figure.

Figure 14:
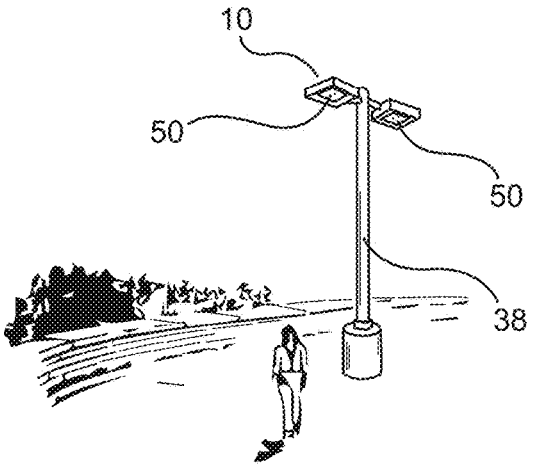
FIG. 14 is a perspective view which shows light sources installed over a parking lot.

FIG. 14 is a perspective view of the same potential lighting of the same possible lighting situation, with the overhead lights 10 mounted on a pole 38 above the parking lot 40.

Figure 15:
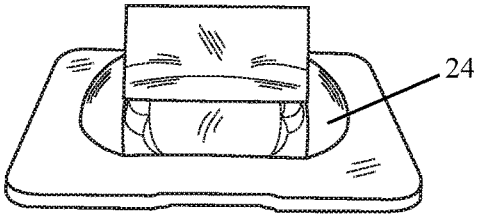
FIG. 15 is a front view of a lens with a prism in the lens shape.
Figure 16:
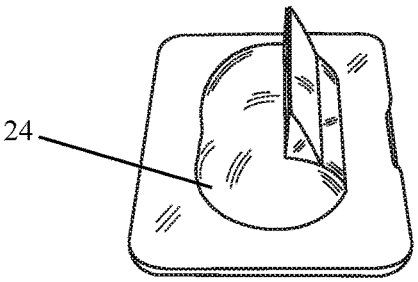
FIG. 16 is a side view of a lens with a prism in the lens shape.
Figure 17:
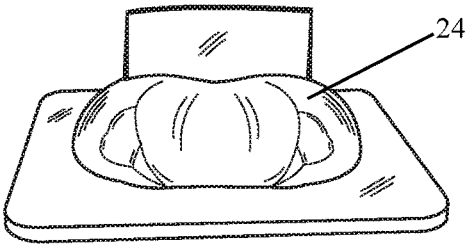
FIG. 17 is a back view of a lens with a prism in the lens shape.
Figure 18:
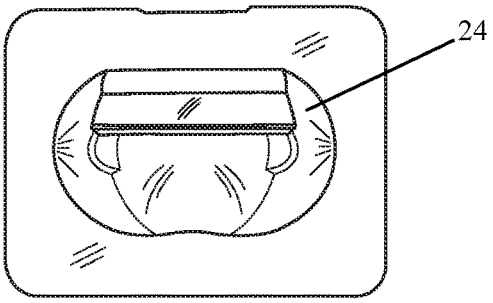
FIG. 18 is a top view of the lens with a prism in the lens shape.

FIGS. 15 and 16 shows a different type of light fixture, which is used to provide a light spread of Type II and Type III. This type of lens is generally oval in shape. To use this shape of lens the base plate is machined to provide a lens groove in an oval pattern. This type of lens is hollow inside, with the prism portion typically being solid. The heat sink can have lens grooves of different shapes, such as round, or ovals at various orientations, or other lens shapes and orientations, and a lens can be placed on a matching lens groove at the time of installations. The lens of FIGS. 15 and 16 has a base place which is screwed down, and the prism can be directed in different directions for a varied light pattern.

The spread of the light field can be adjusted during or after installation of the light body. This can be done is several ways.

1. By placing the proper various lens on the heat sink
2. By rotating the lens on the heat sink before "locking" permanently sealing it.
3. By rotating the module in the fixture.

For example, in FIG. 13 the asymmetrical light patterns are created by selection of lenses and by rotation of those lenses to create the light spread shown.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

We claim:

1. A configurable overhead light, comprising:

a lamp body comprised of a heat sink, with wiring for powering an LED light in said lamp body, with said wiring running to a power source, and at least one LED light mounted on a first surface of said heat sink, with said first surface of said heat sink configured for facing an area to be illuminated, with a second surface of said heat sink attached to a plurality of heat radiating fins;

at least one LED mounted on said first surface of said heat sink;

a lens groove defined in said first surface of said heat sink, with one lens groove surrounding each LED on said heat sink, said lens groove configured to receive an edge of a curvilinear dome shaped lens;

each lens having a circumferential edge and a curvilinear dome shaped upper portion, with said circumferential edge configured for engagement in said lens groove on said first surface of said heat sink, with said lens being selected from a group of differently shaped lenses, with each shape designed to disperse light from said LED into a particular shape of light to illuminate in a selected dispersion pattern; and a waterproof material between each of said lens grooves and each lens, for holding said lens in place on said heat sink in a waterproof attachment.

2. The configurable overhead light of claim 1 in which said heat sink is planar.

3. The configurable overhead light of claim 1 in which said curvilinear dome shaped lens is generally hemispherical in shape.

4. The configurable overhead light of claim 3 in which an output color temperature is between 2700K to 5600K.

5. The configurable overhead light of claim 1 which further comprises interchangeable LED light sources, for creating light of a desired intensity of output lumens and color temperature.

6. The configurable overhead light of claim 1 in which said LED produces between 1000 and 10,000 lumens.

7. The configurable overhead light of claim 1 in which said lenses are selected from the group of lenses consisting of domes with ribs on the outside of the dome, domes with ribs on the inside of the lens, clear lenses, frosted lenses, directional lenses, partially opaque lenses incorporating an internal reflective coating on the opaque portion of the lens and lenses made of a dome with a wedge shaped radial projection.

8. The configurable overhead light of claim 1 which further comprises two LEDs, two lens grooves, and two lenses per lamp body.

9. The configurable overhead light of claim 1 in which said waterproof material holding said lens in place is a glue that is installed as a liquid and which cures into a solid.

10. The configurable overhead light of claim 1 in which said waterproof material holding said lens to said lens groove is an O ring.

11. A method of retrofitting a configurable LED light into an existing overhead light, comprising the steps of:

removing a non-LED light body from an overhead light fixture;

placing a power source for the LED lamp body in the now empty overhead light fixture;

placing an LED lamp body in said overhead light fixture, said lamp body comprised of a planar heat sink with a first surface and a second surface, with a plurality of heat radiating fins attached to said second surface, and with at least one LED light mounted on said first surface of said heat sink and surrounded by a lens groove defined in said first surface, with said first surface of said heat sink configured for facing an area to be illuminated, with wiring for powering said at least one LED light in said lamp body connecting said at least one LED light and a power source;

determining a preferred light pattern to be illuminated by said light fixture;

selecting a curvilinear dome shaped lens with a shape and surface pattern matching the selected light pattern to be illuminated; and attaching said lens to said lens groove to cover and seal off said at least one LED.

12. The method of claim 11 which further comprises the step of adjusting the selected light pattern by one of more of the steps of choosing a lens of a selected light pattern on said heat sink, rotating the lens on the heat sink before permanently sealing in place, or rotating the lamp body in said overhead light fixture.

* * * * *